US005491938A

United States Patent [19]

Niwa et al.

[11] Patent Number: 5,491,938

[45] Date of Patent: Feb. 20, 1996

[54] HIGH DAMPING STRUCTURE

[75] Inventors: Naoki Niwa; Takuji Kobori; Motoichi Takahashi; Narito Kurata; Takayuki Mizuno; Masatoshi Ishida; Tomohiko Hatada, all of Tokyo, Japan

[73] Assignee: Kajima Corporation, Tokyo, Japan

[21] Appl. No.: 272,032

[22] PCT Filed: Oct. 18, 1991

[86] PCT No.: PCT/JP91/01426

§ 371 Date: Jun. 17, 1992

§ 102(e) Date: Jun. 17, 1992

[87] PCT Pub. No.: WO92/83333

PCT Pub. Date: May 14, 1992

Related U.S. Application Data

[63] Continuation of Ser. No. 861,842, Jun. 17, 1992, abandoned.

[30] Foreign Application Priority Data

Oct. 19, 1990 [JP] Japan ..... 2-280712
Aug. 30, 1991 [JP] Japan ..... 3-219959

[51] Int. Cl.[6] ..... E04H 9/02

[52] U.S. Cl. ..... 52/167.1; 52/167.3

[58] Field of Search ..... 52/167 R, 167 CB, 52/167 DF, 1

[56] References Cited

U.S. PATENT DOCUMENTS

| | | | |
|---|---|---|---|
| 3,538,653 | 11/1970 | Meckler | 52/167 R |
| 3,796,017 | 3/1974 | Meckler | 52/167 X |
| 4,318,768 | 12/1988 | Cardan | 52/167 R |
| 4,799,339 | 1/1989 | Kobori et al. | 52/167 CB |
| 4,890,430 | 1/1990 | Kobori et al. | 52/167 CB |
| 4,901,486 | 2/1990 | Kobori et al. . | |
| 4,922,667 | 5/1990 | Kobori et al. | 52/167 CB |
| 4,959,934 | 10/1990 | Yamada et al. . | |
| 4,964,246 | 10/1990 | Kobori et al. | 52/1 |
| 5,022,201 | 6/1991 | Kobori et al. | 52/167 DF |
| 5,025,599 | 6/1991 | Ishii et al. | 52/167 DF |
| 5,036,633 | 8/1991 | Kobori et al. | 52/167 R |
| 5,046,290 | 9/1991 | Ishit et al. | 52/167 R |
| 5,065,552 | 11/1991 | Kobori et al. | 52/167 CB X |
| 5,097,547 | 3/1992 | Tanaka et al. | 52/167 R |
| 5,107,634 | 4/1992 | Onoda et al. | 52/167 DF |
| 5,147,018 | 9/1992 | Kobori et al. | 52/167 CB |
| 5,271,197 | 12/1993 | Uno et al. | 52/167 R |
| 5,339,580 | 8/1994 | Koshika et al. | 52/167 R |
| 5,347,771 | 9/1994 | Kobori et al. | 52/167 R |

FOREIGN PATENT DOCUMENTS

| | | | |
|---|---|---|---|
| 52-13865 | 4/1977 | Japan . | |
| 54-19710 | 7/1979 | Japan . | |
| 56-23515 | 6/1981 | Japan . | |
| 63-130940 | 6/1988 | Japan | 52/167 CB |
| 1-236333 | 10/1989 | Japan . | |
| 1-263332 | 10/1989 | Japan | 52/167 CB |
| 1-263333 | 10/1989 | Japan | 52/167 DF |
| 2-112536 | 4/1990 | Japan . | |
| 2-209571 | 8/1990 | Japan | 52/167 CB |
| 2-209568 | 8/1990 | Japan | 52/167 CB |
| 2-236326 | 9/1990 | Japan | 52/167 CB |
| 2-248581 | 10/1990 | Japan . | |
| 2-248542 | 10/1990 | Japan | 52/167 CB |
| 3-235856 | 10/1991 | Japan | 52/167 CB |
| 1318679 | 6/1987 | U.S.S.R. | 52/167 DF |

*Primary Examiner*—Rodney M. Lindsey
*Attorney, Agent, or Firm*—James H. Tilberry

[57] ABSTRACT

A high damping device combined with the frame of a building to protect the building from seismic shock. For seismic vibration up to a predetermined level corresponding to the permissible strength of the high damping device, a damping coefficient c of the high damping device is set so as to be $c_3=c=c_1$ with respect to a damping coefficient $c_3$ for giving the maximum value of a damping factor $h_3$ corresponding to a tertiary mode of vibration of the structure and a damping coefficient $c_1$ for giving the maximum value of a damping factor $h_1$ corresponding to a primary mode of vibration. The maximum load on the high damping device is predetermined and means are provided to prevent the high damping device from being damaged in the event that the predetermined maximum load is exceeded. The inventive combination permits the stiffness factor of the building to be reduced from a factor of 1.0 down to a factor as low as 0.3, with a proportionate reduction in steel frame mass.

10 Claims, 8 Drawing Sheets

HIGH DAMPING STRUCTURE

This is a continuation of application Ser. No. 07/861,842, filed Jun. 17, 1992, now abandoned.

BACKGROUND OF THE INVENTION

1. Field of the Invention

The field of invention comprises devices for damping vibrations of structures caused by seismic shock or the like.

2. Description of Related Art

A variety of active and passive seismic response control systems are known, including variable stiffness devices, to provide for the safety of structures. For instance, a variable stiffness earthquake-resisting mechanism may be integrated in a column-and-beam type frame structure in the form of an adjustable brace in which the rigidity of the variable stiffness mechanism, or the means of connection between the frame and the variable stiffness mechanism, functions to analyze seismic vibrational forces and to provide damping to offset these forces.

Prior art active seismic response control systems attempt to deal with seismic vibrations by actively shifting the natural frequency of the structure against the predominant period of a seismic vibration. However, seismic motion is an irregular vibration which does not have a clear predominant period, and in some instances, the predominant period is plural. Furthermore, in the case of prior art active seismic response control systems, various sensors as well as a controlling computer are used. To safeguard against the possibility of unforeseen events, a variety of safety maintenance mechanisms are necessary, the control of which becomes complicated. These safety mechanisms are not only costly, but require valuable start-up time to become effective. During this start-up period, the structure is either unprotected or not fully protected.

For instance, Kobori et al. U.S. Pat. No. 4,890,430 discloses an active damper which is computer controlled to vary the natural resonance of an entire building by actively varying the rigidity of selected structural members. Kobori. et al. U.S. Pat. No. 5,022,201 is an active seismic damper comprising a mass damper mounted on the top of a building. The damper is actively vibrated by an actuator connecting the mass to the building. Ishii et al. U.S. Pat. No. 5,025,599 discloses a combination active and passive damping device wherein a mass damper is rendered actively vibratable by a hydraulic actuator. In the event of a power failure, the device is converted to a passive damper wherein the mass is passively vibratable by coiled springs between the mass and the building which are excited solely by the energy of seismic vibration.

SUMMARY OF THE INVENTION

As used in this specification, the following definitions shall apply:

1. Active damper shall mean a seismic vibration damping device which, in order to function, requires an actuator energized by means other than the energy of seismic vibration.

2. Passive damper shall mean a seismic damping device which functions without an actuator and is energized solely by the energy of seismic vibration.

3. Actuator shall mean a mechanical, electro-mechanical, electrical, and/or electronic means for energizing an active damper.

4. Control force shall mean the force applied by a seismic vibration damping device to a structure to damp seismic vibrations in the structure.

5. Fail safe means shall mean a device to automatically deactivate a seismic vibration damper to protect the damper from damage due to overload or malfunction.

6. Column and beam shall mean state of the art construction materials used to form the vertical and horizontal frame portions of a structure.

The basic concept of the invention is to use a rigid frame structure with a stiffness factor of approximately one-half of the stiffness and strength factor of a frame required in a normal design. To compensate for the reduced rigidity of the frame structure, the damping devices, in combination with earthquake-resisting elements, such as braces, are secured to the column-and-beam frame of the structure. Maximum damping capacity is obtained for the structure, and the response of the structure is minimized by preliminarily setting the damping coefficient of the inventive high damping device at a proper value. Although a structure having one-half of the frame stiffness of a prior art structure is an example of a structure suitable for protection by the inventive high damping device, the invention provides effective protection for column-and-beam frames having a stiffness and strength factor substantially within a range of 0.3 through 1.0 of the stiffness of a prior art structure designed and equipped with prior art earthquake-resisting devices. In the case where the structure stiffness factor exceeds 1.0, seismic response reduction becomes progressively less effective. On the other hand, where the strength of the structure is less than 0.3, effective damping becomes substantially impossible because of the shearing forces to which the column-and-beam frame is subjected.

According to the present invention, earthquake-resisting braces are provided within a predetermined column-and-beam type frame of a structure. Either the column-and-beam frame and the braces are interconnected with the inventive high damping devices, or only the braces are interconnected by the inventive high damping devices, which are capable of giving a damping coefficient c within a predetermined range, including a damping coefficient for minimizing the response of the structure to an earthquake.

With reference to the damping coefficient c of the high damping device, a damping factor of each vibration mode of the structure is obtained by the following formula (1):

$$H_1 = -Re\,(\lambda i)/|\lambda i| \qquad (1)$$

wherein

λi:an i-th complex natural value hi:an i-th damping factor, and

Re(λi):a real number part of the i-th complex natural value.

The damping coefficient c of the high damping device is taken as being set in the neighborhood of such damping coefficients $c_1$, $c_2$ and $c_3$ which give the maximum values of damping factors $h_1$, $h_2$ and $h_3$ corresponding to the primary through tertiary vibration modes, respectively.

With reference to the damping capacity of the structure, a most advantageous condition can be obtained by setting the coefficient c within the range:

$$c_3 \leqq c \leqq c_1$$

The damping coefficient c of the high damping device is preliminarily set in the neighborhood of the damping coefficients $c_1$, $c_2$ or $c_3$ (e.g., 25 cm/sec) which provide the maximum values of the damping factors $h_1$, $h_2$ and $h_3$ corresponding to the primary through tertiary vibration modes as described above, and the damping coefficient of the high damping device is preset for the seismic motion at a predetermined vibration level.

Seismic response control can also be accomplished by defining the damping coefficient c as $c_a=F_a/V_L$, wherein $F_a$ is the permissible strength of the high damping device and $V_L$ is a response velocity of the high damping device due to an earthquake at a predetermined vibration level. The damping coefficient c of the high damping device may also be expressed as $c_x=F_a/V_x$ wherein $F_a$ is the permissible strength of the high damping device and $V_x$ is a response velocity of the high damping device due to an earthquake) for an earthquake at the preceding predetermined vibrational level.

Assuming that the permissible strength $F_a$ of a single high damping device is 100 tons, maximum damping is provided for the structure while keeping the damping coefficient c at a predetermined constant value of 25 tons per cm/sec responsive to seismic vibration up to a level of 25 cm/sec, for an earthquake having the maximum speed standardized to 25 cm/sec. The load is kept at approximately 100 tons of the permissible strength by gradually decreasing the preset damping coefficient from 25 cm/sec. Within these parameters, damping can be provided for the structure within the capacity of the device while at the same time protecting the device from damage should the seismic vibrations exceed the capacity of the device. It is desirable that the damping coefficient $c_a$ within a predetermined vibrational level be within the range of $c_3$ through $c_1$. When the damping coefficient $c_a$ falls below this range, the damping effectiveness decreases. Also, when the damping coefficient $c_a$ exceeds this range, it becomes difficult to design a high damping device having the capacity to damp such high energy vibration loads.

OBJECTS OF THE INVENTION

It is among the objects of this invention to provide a passive seismic response control mechanism which does not need as part of the control system a computer program or the like; to permit a structure to have a high damping capacity by properly connecting an earthquake vibration resisting element, such as a brace, to a high damping device, which are then interconnected within a column-and-beam type frame structure; to reduce the vibrations of a structure due to external disturbances such as earthquake, wind, or the like; and to provide safe living space within the structure during a seismic disturbance.

BRIEF DESCRIPTION OF THE DRAWINGS

The foregoing and other objects and advantages of the invention will be apparent from the following description of preferred embodiments of the invention with reference to the accompanying drawings, in which.

DESCRIPTION OF PREFERRED EMBODIMENTS OF THE INVENTION

Figure 1:
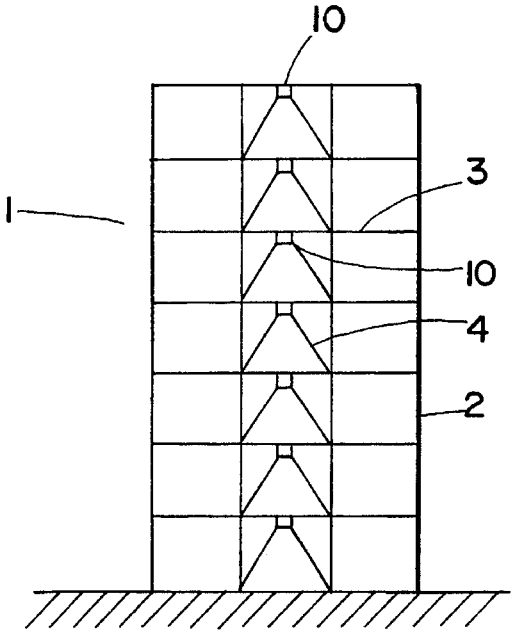
FIG. 1 is a schematic front elevational view of a structure equipped with the inventive high damping devices.
Figure 2:
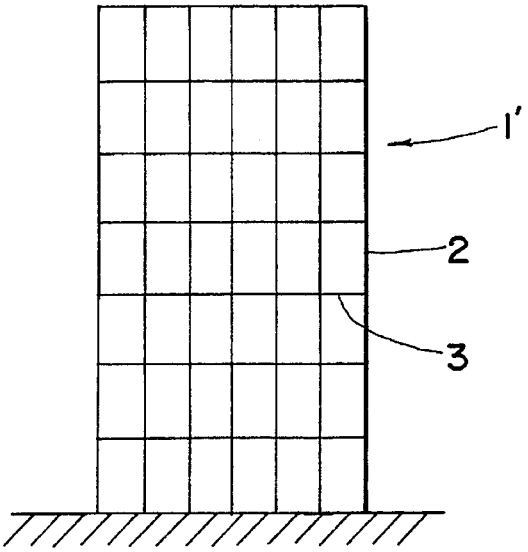
Fig. 2 (PRIOR ART)
FIG. 2 is a schematic front elevational view of a prior art structure.

Referring first to FIG. 1, therein is shown a structure 1 employing the inventive high damping device 10, having a column-and-beam type frame which requires approximately only one-half of the columns 2 required of a conventional prior art structure, such as shown in FIG. 2, having the same number of stories. Inverted V-type braces 4, functioning as earthquake-resisting elements, and high damping devices 10 are locally installed at each floor level 3 to absorb vibrational energy impacting the structure.

Figure 3:
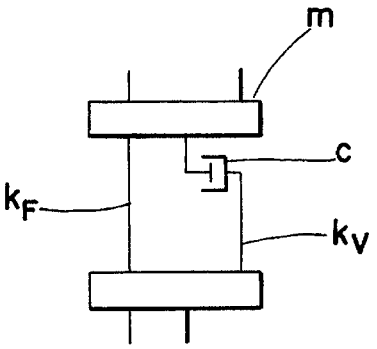
FIG. 3 is a schematic diagram of a vibration model of one-story of a structure protected with the present invention.

FIG. 3 schematically shows a single story model of the inventive high damping device, in which c is the damping coefficient of the device, $K_F$ is the stiffness of the column-and-beam frame, and $K_V$ is the stiffness of the brace. With this model, the natural value of a multi-story building can be obtained, and a damping factor for each mode of the structure can be calculated by formula (1), set forth above.

Figure 4:
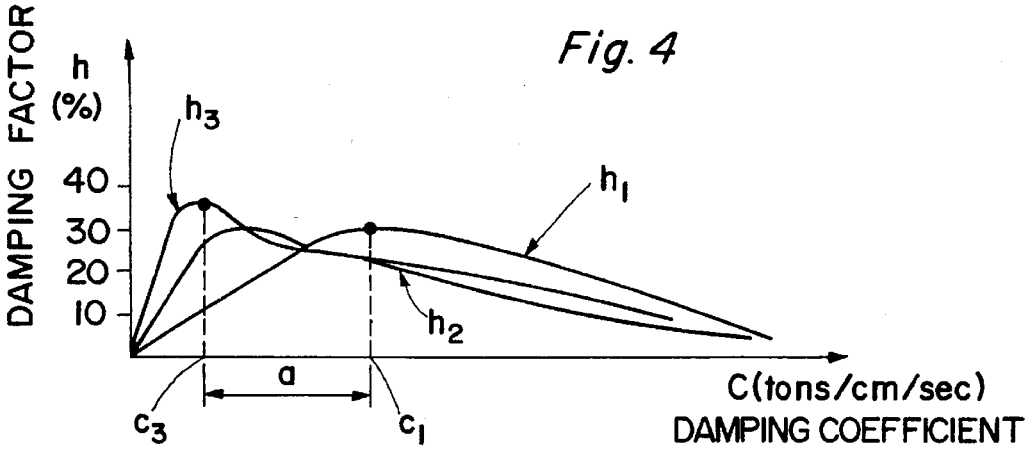
FIG. 4 is a graph showing the relationship between the primary through tertiary damping factors of a column-and-beam type frame structure provided by primary through tertiary damping coefficients.

The graph of FIG. 4 shows the relation between the damping factor h(%) of the frame's natural period and the damping coefficient c (tons/cm/sec) of the inventive high damping device 10 for each floor level of the structure with respect to primary through tertiary coefficient modes and their corresponding damping factors. If the damping coefficient c of the inventive high damping device 10 is set within the range a where each damping factor $h_1$, $h_2$ or $h_3$ falls within the range of 10 through 40%, a sufficient response reduction effect to seismic vibration can be obtained. Within this range a, the difference between the peak of the tertiary damping factor $h_3$ and the peak of the primary damping factor $h_1$ is significant, since it is advantageous to obtain both a damping coefficient $c_3$ which obtains the maximum value of the damping factor $h_3$ for the tertiary mode and a damping coefficient $c_1$ which obtains the maximum value of the damping factor $h_1$ for the primary mode, and to set the damping coefficient c of the high damping device as $c_3 \leqq c \leqq c_1$.

If the damping coefficient c is less than $c_3$, the deformation of the frame rapidly increases. On the other hand, if the damping coefficient c is more than $c_1$, there is not much difference in the vibration control effect, although the strength required for the high damping device increases.

Figure 5:
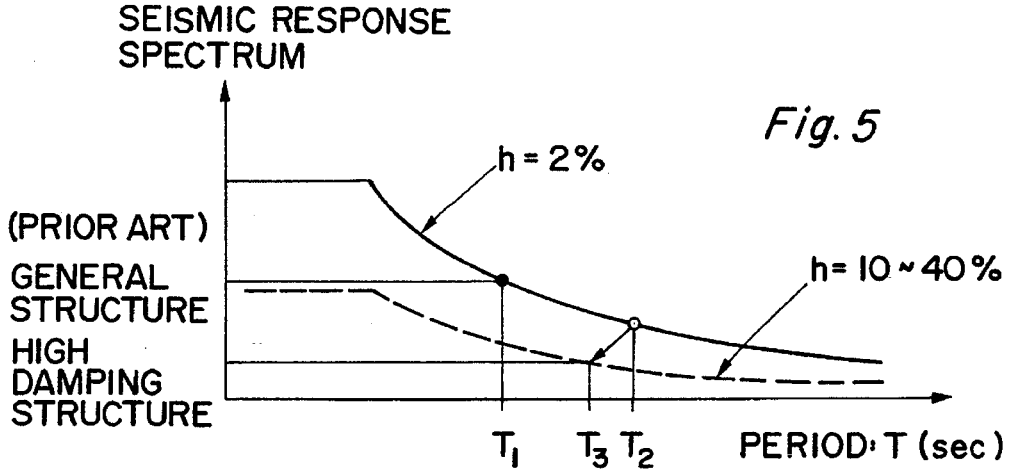
FIG. 5 is a graph comparing responses to vibration of a prior art structure and a structure protected with the inventive high damping device.

The graph of FIG. 5 illustrates the response reduction effect observed on the basis of a seismic response spectrum. By approximately halving the column-and-beam frame natural period ($T_1$) of a prior art structure, the natural period ($T_2$) is extended and the spectrum itself is lowered. At the same time, since the damping effect increases by approximately 2% up to 10 through 40%, the response spectrum is further lowered and the natural period is slightly shortened, as shown at $T_3$. At this time, the increase of the structural deformation, which normally becomes a problem, can be controlled because the damping effect increases.

With reference to the foregoing discussion of FIGS. 4 and 5, the permissible strength of the high damping device should be taken into consideration as well. Thus, since the load applied on the inventive high damping device is roughly proportional to the scale and velocity of the seismic vibrations when the damping coefficient c is constant, when the damping coefficient c is decreased responsive to an earthquake exceeding a predetermined level (e.g., 25 cm/sec), the applied load will decrease to a level commensurate with the designed strength of the inventive high damping device.

Figure 6:
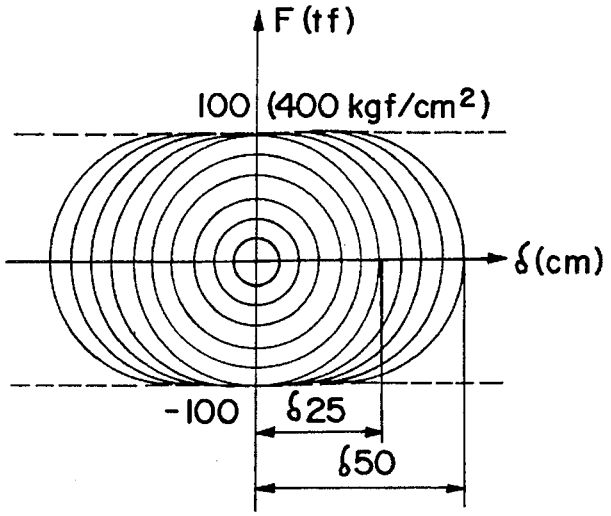
FIG. 6 is a graph showing the relation between a seismic load and the effect of the inventive high damping device.
Figure 7:
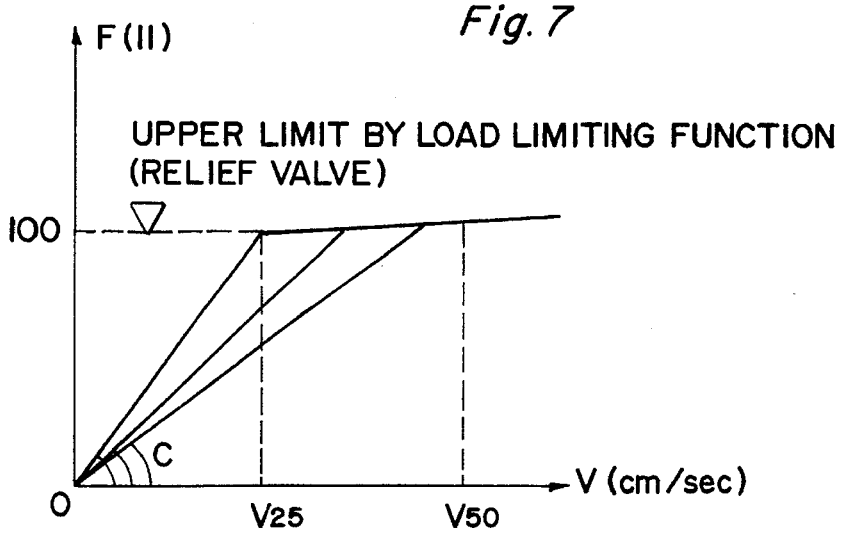
FIG. 7 is a graph showing the relation between a seismic load and the velocity of the inventive high damping device.

FIGS. 6 and 7 are graphs showing effects of load on an inventive high damping device. FIG. 6 shows the relationship between load and displacement against a sine wave expressed as $F=c_V$, wherein F is a load applied on the inventive device, c is the damping coefficient (tons/cm/sec) of the device, and V is the velocity (cm/sec) of the device in response to an earthquake. Displacement of the inventive device in response to a level 25 cm/sec earthquake is indicated by the $\delta_{25}$ arrow. Displacement of the inventive device in response to a level 50 kine earthquake is indicated by the $\delta_{50}$ arrow. FIG. 7 shows the relationship between load and velocity, and both figures indicate an upper load limit of 100 tons. It is found that the damping coefficient c of the inventive device decreases from a velocity of $V_{25}$ or a displacement of $\delta_{25}$ in response to an earthquake at a level of 25 cm/sec.

By way of example, assume a twenty-four story building, having a rigid steel frame structure 98.1 m in height, 3.90 m in typical floor height, and 1269 $m^2$ in typical floor area, and assume that the maximum velocity amplitude of the input seismic motion is at a level of 50 cm/sec. Also assume that four inventive high damping devices are required on every floor of the building in order to have the required strength in the event of seismic loads in the order of 200 tons. The damping coefficient c is set at 25 tons/cm/sec in order to limit the maximum load to under 100 tons applied to each inventive high damping device, and the damping coefficient c is decreased against earthquakes exceeding the 25 cm/sec level so as to avoid harmful increase of the load on each of the inventive devices per se. Thus, in the inventive high damping device the relationship between a load F and a velocity V produced on the high damping device approaches linearity.

Figure 8:
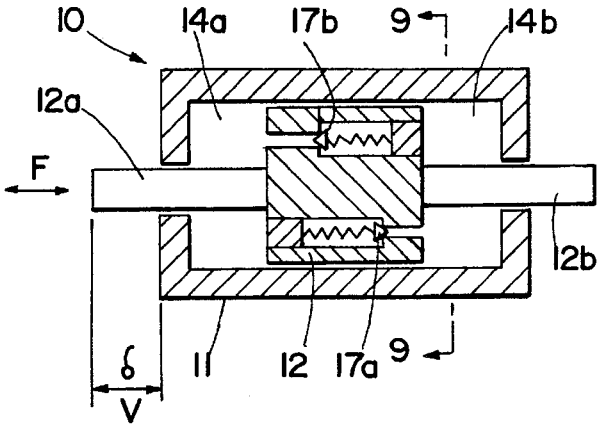
FIG. 8 is a basic schematic sectional view of the inventive high damping device.

As an embodiment of the inventive high damping device 10, FIG. 8 shows its basic structure, wherein a piston 12, with piston rods 12*a* and 12*b*, is incorporated within a cylinder 11. Pressure regulating valves 17*a* and 17*b* provide two-way flow paths through the piston 12 to enable oil to flow freely between hydraulic chambers 14*a* and 14*b*, depending on which hydraulic chamber is under the greater positive pressure.

In order to protect the inventive device against overload (e.g., in excess of the predetermined level), relief valves 27*a* and 27*b* are provided in piston 12. When a pressure in excess of the designed load is applied, either relief valve 27*a* or 27*b* opens to release the pressure. In installations in which overload cannot occur, the relief valves 27*a* and 27*b* may be eliminated.

Figure 9:
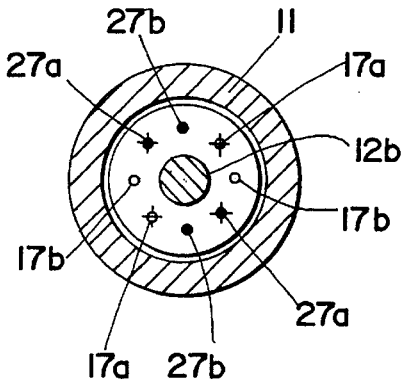
FIG. 9 is a cross-sectional view taken along line 9—9 of FIG. 8.

FIG. 9 shows the arrangement of pressure regulating valves 17*a* and 17*b* and relief valves 27*a* and 27*b*, which are uniformly circumferentially arrayed to form passageways through piston 12.

Figure 10:
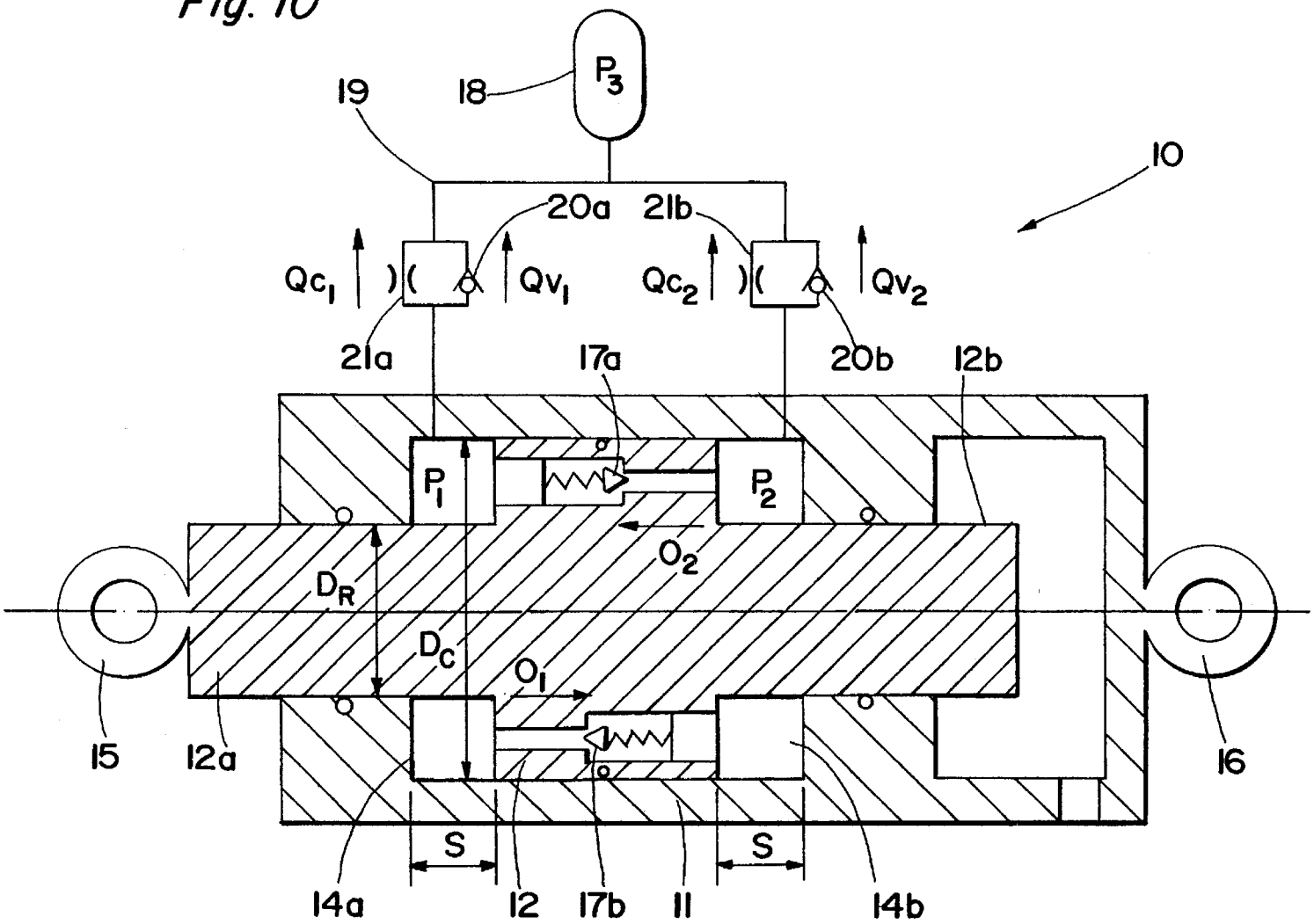
FIG. 10 is a schematic sectional view of another preferred embodiment of the inventive high damping device.

FIG. 10 diagrammatically shows an embodiment of the damping device 10 in which the piston rod 12*a* projects from the cylinder 11 only in one direction, and fastening rings 15 and 16 are provided for connecting the inventive high damping device to portions of a frame, such as shown in FIGS. 15 through 22. The high damping device of FIG. 10 includes an oil accumulator 18 in combination with check valves 20*a* and 20*b* so that the damper will have an adequate supply of oil at all times.

Figure 11:
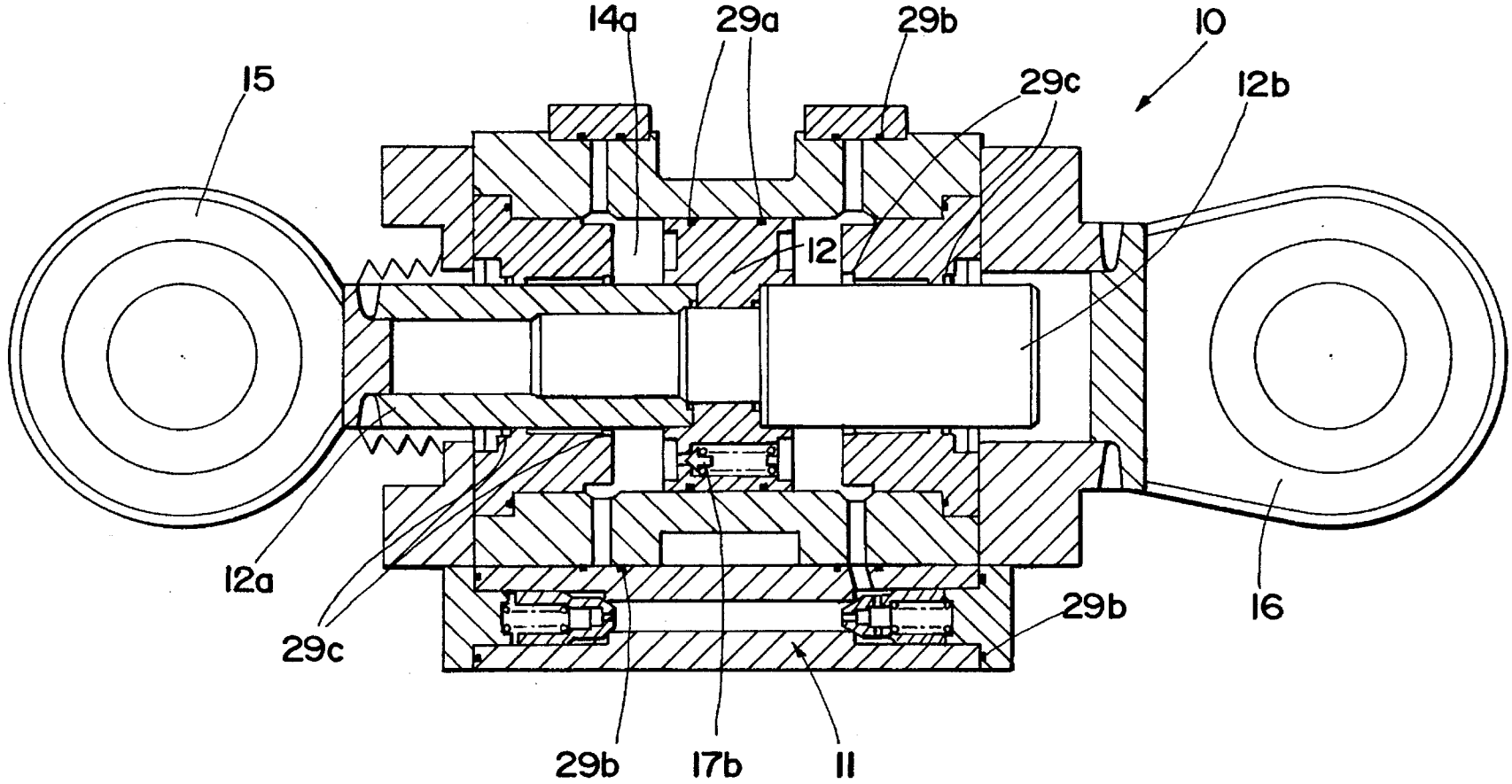
FIG. 11 is a sectional view of yet another embodiment of the inventive high damping device.
Figure 12:
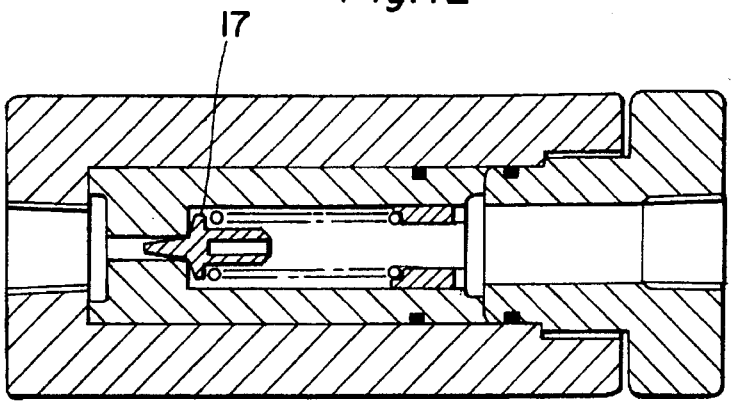
FIG. 12 is a sectional view of a pressure regulating valve used in a preferred embodiment of the invention.

The embodiment of FIG. 11 shows in section pressure regulating valves 17*a* and 17*b* which are provided within the piston 12 for the purpose of preventing oil from leaking to the exterior of the damper. The pressure regulating valves 17*a* and 17*b* are provided with conical poppet valves to provide damping independent of temperature. See also FIG. 12. For durability and reliability, multi-stage metal seals 29*a* are used to seal the piston 12 for sliding contact with cylinder 11. Two-stage metal seals 29*b* are also used as fixed seals. In addition, seals 29*c*, made of a fluorocarbon resin, are provided in two stages for the rod portion, and the seal 29*c* on the external side is replaceable as a cartridge. With this combination of sliding and fixed seals, a high damping coefficient becomes possible by minimizing the potential for high pressure oil leaks in the system. A three-directional rotatable clevis may be used for connecting the fitting ring 15 to a frame member.

Figure 13:
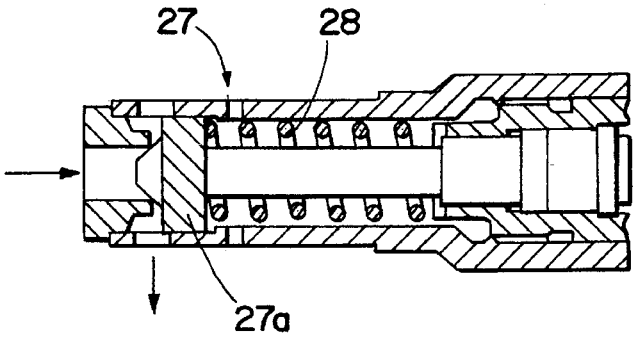
FIG. 13 is a sectional view of a relief valve used in a preferred embodiment of the invention.

Referring to FIG. 13, therein is shown, in an open-pressure setting, spring 28 in relief valve 27. When the seismic vibration of an earthquake exceeds a predetermined level of energy, resulting in pressure at an inflow portion of the total surface of a valve reaching a pressure higher than a designed pressure, the relief valve 27 has a pressure pad 27*a* for opening the valve against the resistance of the spring 28 to release the pressure.

Figure 14:
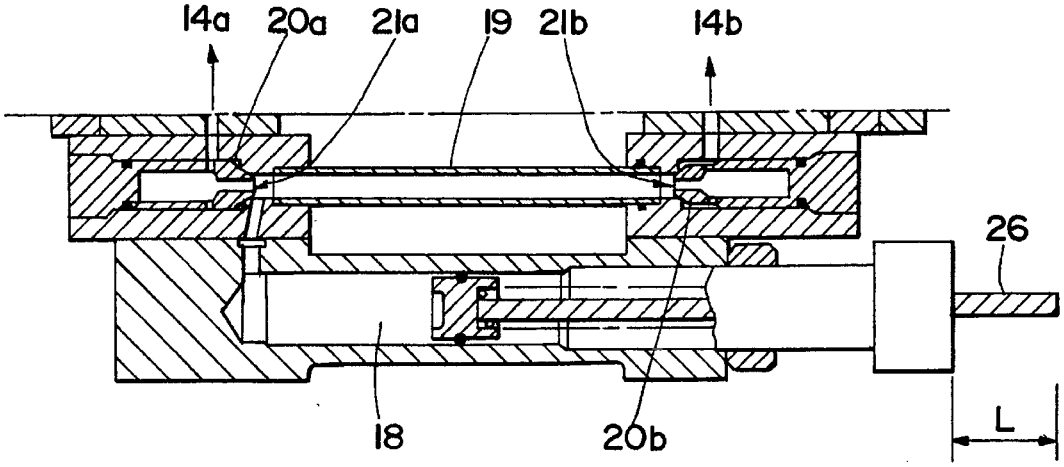
FIG. 14 is a sectional view of a by-pass line and an accumulator device used in a preferred embodiment of the invention.

FIG. 14 shows by-pass line 19 and the accumulator 18 which are mounted on the surface of the casing 11 of the high damping device 10. A check valve 20*a*, for preventing an oil flow toward the side of the hydraulic chamber 14*a*, is provided between the hydraulic chamber 14*a* and the accumulator 18, and a check valve 20*b* for preventing an oil flow toward the side of the hydraulic chamber 14*b* is provided between a hydraulic chamber 14*b* and the accumulator. Moreover, check valves 20*a* and 20*b* are attached to orifices 21*a* and 21*b*, respectively, passing through each of the check valves (in parallel with each other as shown in FIG. 10) to linearize the damping characteristics of the high damping device 10 and to relieve a pressure build-up within either hydraulic chamber 14*a* or 14*b*.

FIGS. 15 through 22 show installation embodiments of the high damping device 10 within a column-and-beam type frame.

Figure 15:
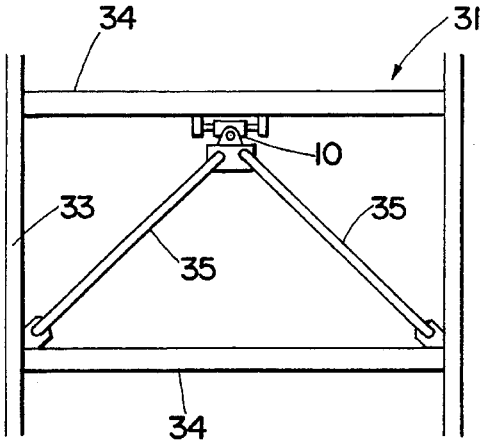
FIG. 15 is a schematic elevational fragmentary view of an embodiment of a post-and-beam type frame of a structure equipped with an inventive high damping device secured to a system of inverted V-braces.

In the embodiment of FIG. 15, the high damping device 10 is interposed between a column-and-beam frame 31 and an inverted V-type brace 35, which functions as the earthquake-resisting element.

Figure 16:
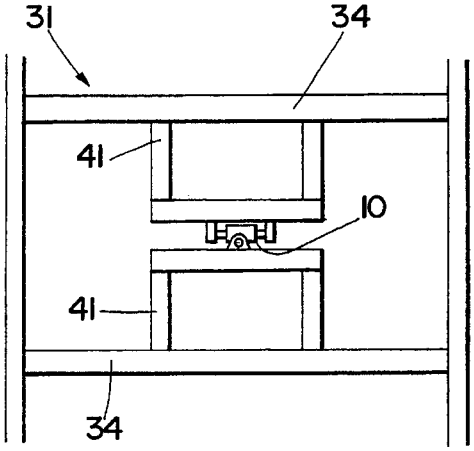
FIG. 16 is a schematic fragmentary elevational view of an embodiment of a post-and-beam type frame of a structure equipped with an inventive high damping device and U-shaped connecting brace members.

The embodiment shown in FIG. 16 employs U-shaped braces 41 which act as earthquake-resisting elements. The high damping device 10 is secured between the U-shaped braces 41, which are secured to beams 34 and extend vertically therefrom.

Figure 17:
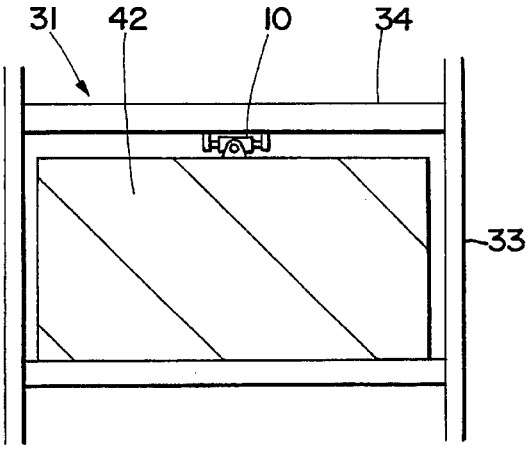
FIG. 17 is a schematic fragmentary elevational view of an embodiment of a post-and-beam type frame of a structure equipped with an inventive high damping device connected to a seismic shock-resisting wall type brace and with the inventive high damping device oriented in a horizontal mode on the top edge of the seismic shock-resisting wall type brace.

In the embodiment of FIG. 17, the high damping device 10 is interposed between the upper beam 34 and an earthquake-resisting wall brace 42.

Figure 18:
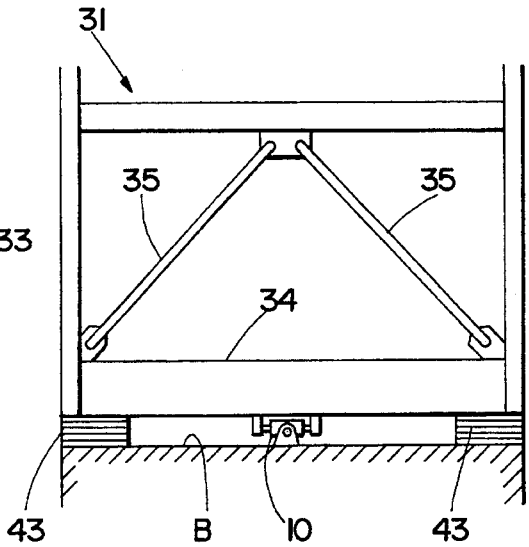
FIG. 18 is a schematic fragmentary elevational view of an embodiment of a post-and-beam type frame of a structure equipped with an inventive high damping device secured between a beam and the foundation of the structure.

In the embodiment shown in FIG. 18, the high damping device 10 is secured between the lower beam 34 and the base B of a structure mounted on base isolation pads 43. The earthquake-resisting element is an inverted V-type brace 35, similar to the brace shown in FIG. 15.

Figure 19:
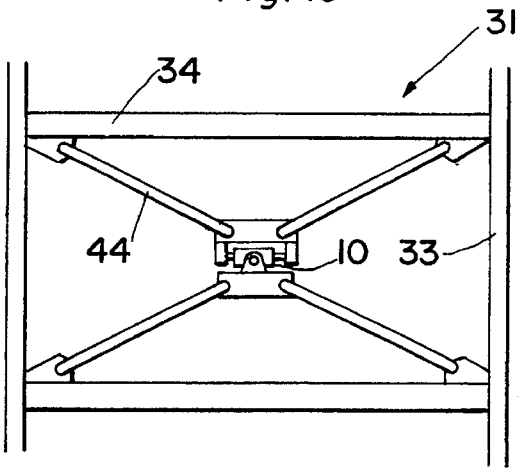
FIG. 19 is a schematic fragmentary elevational view of an embodiment of a post-and-beam type frame of a structure equipped with an inventive high damping device in a horizontal mode secured to a system of cross braces.

In the embodiment of FIG. 19, an earthquake-resisting X-type brace 44 is installed within the column-and-beam frame 31. The high damping device 10 is horizontally secured at the center of the brace.

Figure 20:
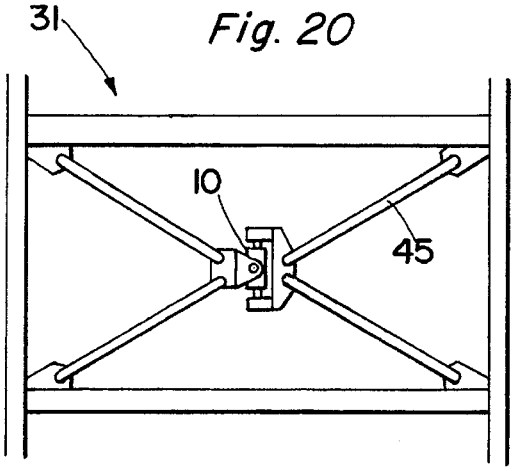
FIG. 20 is a schematic fragmentary elevational view of an embodiment of a post-and-beam type frame of a structure equipped with an inventive high damping device secured to a system of cross braces, similar to FIG. 19, but with the inventive high damping device in a vertical mode.

In an embodiment similar to that of FIG. 19, the embodiment shown in FIG. 20 comprises the high damping device 10 vertically secured to an X-type brace 45.

Figure 21:
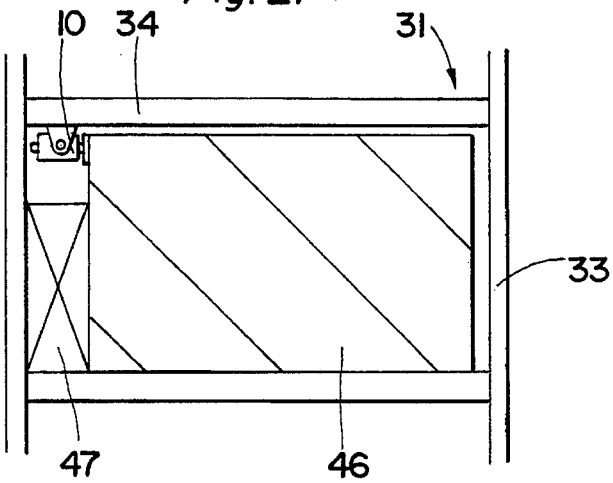
FIG. 21 is a schematic fragmentary elevational view of an embodiment of a post-and-beam type frame of a structure equipped with an inventive high damping device secured to a seismic shock-resisting wall brace, similar to FIG. 17, but with the inventive high damping device secured to a vertical side edge of the seismic shock-resisting wall brace.

In an embodiment similar to that shown in FIG. 17, the embodiment shown in FIG. 21 discloses the high damping device 10 interposed between the beam 34 and an earthquake-resisting wall brace 46, wherein the high damping device 10 is secured to the vertical edge of the wall brace 46 and over a doorway 47.

Figure 22:
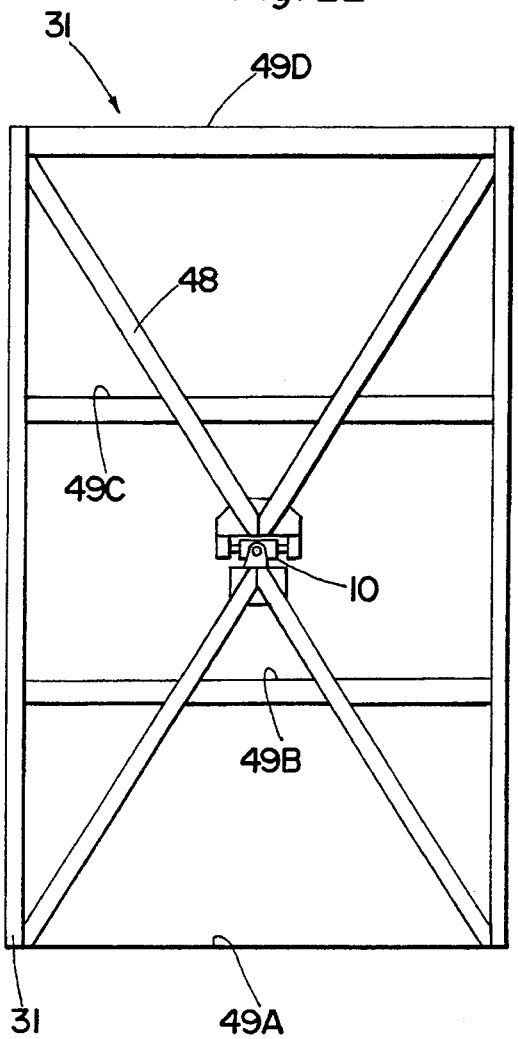
FIG. 22 is a schematic fragmentary elevational view of an embodiment of a post-and-beam type frame of a structure equipped with an inventive high damping device, similar to FIG. 19, but with the cross braces extended so as to secure a plurality of stories of the structure with a single inventive high damping device.

In the embodiment shown in FIG. 22, the high damping device 10 is horizontally interposed at the center of an X-type brace 48 which extends over three stories of a structure, from floor 49A to floor 49D, with the extremities of the X-type brace secured only to floors 49A and 49D.

POSSIBILITY OF INDUSTRIAL UTILIZATION

The following advantages will be obtained by applying a high damping device of the present invention to buildings which are at risk to the ravages of earthquakes and high winds.

1. Since the number of columns of a column-and-beam structure can be reduced by approximately 50%, not only is the saving in structural steel considerable, but the additional unobstructed floor space between columns considerably increases the floor planning possibilities.

2. Since the response of the structure to earthquake shock and high winds is reduced, the safety of the occupants and of the structure is increased.

3. Since the invention is a passive type damper mechanism, only fine tuning adjustments to the particular characteristics of the structure are required when installed.

4. Since complicated active seismic control systems and attached facilities are not required, installation costs are low in comparison to the costs of active seismic response control mechanisms.

5. The effective load applied to the inventive high damping device may be decreased by reducing the damping coefficient for seismic vibration to a predetermined safe level.

6. The number of inventive damping devices to be installed on each floor of a building can be predetermined.

7. Since the designed load limit of the inventive device cannot be exceeded, the cost of material and labor for related support structure can be reduced and a compact installation can be obtained.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

We claim:

1. In combination, a multi-storied structure having column and beam frame members; earthquake-resisting braces secured to and reinforcing said frame members; non-variable, self-contained passive hydraulic damping devices secured between said frame members, or between one of said frame members and one of said earthquake-resisting braces, or between said earthquake-resisting braces on the individual stories of said multi-storied structure, said passive hydraulic damping devices being energized solely by seismic vibrations impacting on said frame members to independently passively damp said seismic vibrations up to a predetermined level; and fail safe means to prevent vibration overload on said non-variable, self-contained hydraulic damping devices, said non-variable, self-contained hydraulic damping devices having predetermined non-variable damping coefficients preselected and preset to provide damping factors within predetermined ranges.

2. The combination of claim 1, wherein said steel frame members provide a structure having a stiffness factor within the range of thirty to one hundred percent.

3. The combination of claim 1, wherein said damping factor is within the range of ten to forty percent.

4. The combination of claim 1, wherein one or more of said passive hydraulic damping devices are secured to one or more of said stories of said multi-storied structure and the said non-variable coefficients of damping of said non-variable passive hydraulic devices are selectively preset and fixed for each of said stories to coordinate the overall damping effect of said passive hydraulic damping devices on seismic vibrations.

5. The combination of claim 4, wherein a plurality of said passive hydraulic damping devices are secured to each of said stories of said multi-storied structure.

6. The combination of claim 1, wherein said multi-storied structure has high, intermediate, and low modes of natural vibration, and said non-variable coefficients of damping of said non-variable passive hydraulic damping devices are selectively preset and fixed to maximize damping of said intermediate mode of vibration.

7. In combination, a multi-storied structure having column-and-beam frame members; earthquake-resisting braces secured to and reinforcing said frame members; and passive hydraulic damping devices secured between said frame members or between one of said frame members and one of said earthquake-resisting braces or between said earthquake-resisting braces; said structure having natural modes of vibration $V_1$, $V_2$ and $V_3$ wherein a damping coefficient $c_1$ provides a maximum damping factor $h_1$, a damping coefficient $c_2$ provides a maximum damping factor $h_2$, and a damping coefficient $c_3$ provides a maximum damping factor $h_3$, in which the relationship of said coefficients is $c_1 \leqq c_2 \leqq c_3$; means to provide said hydraulic damping devices with a fixed preset damping coefficient $c_2$ set at a predetermined level; means to preset said hydraulic damping devices to prevent overloading by seismic vibrations exceeding a preset predetermined level; and means to maintain said damping coefficient $c_2$ at said fixed preset predetermined level.

8. The combination of claim 7, wherein said column-and-beam type frame has a stiffness factor within the range of thirty to one hundred percent.

9. The combination of claim 7, wherein the said damping factor $h_2$ is within the range of ten to forty percent.

10. The combination of claim 7, wherein said damping device comprises a hydraulic cylinder having first and second pressure responsive hydraulic chambers; means to permit hydraulic fluid to flow from said first hydraulic chamber to said second hydraulic chamber responsive to a first level of seismic force; means to permit hydraulic fluid to flow from said second hydraulic chamber to said first hydraulic chamber responsive to a second level of seismic force; and said means to prevent said damping device from becoming overloaded by vibrations including hydraulic relief valves between said first and second hydraulic chambers.

* * * * *